US005825278A

United States Patent [19]

Reid et al.

[11] Patent Number: 5,825,278

[45] Date of Patent: Oct. 20, 1998

[54] THERMAL PELLET CUTOFF SWITCH

[75] Inventors: Carl R. Reid; David Lanham; Matt M. Grist, all of London, Ky.; James B. Kalapodis, Akron, Ohio

[73] Assignee: Therm-O-Disc, Incorporated, Mansfield, Ohio

[21] Appl. No.: 722,613

[22] Filed: Sep. 27, 1996

[51] Int. Cl.[6] ..... H01H 37/76

[52] U.S. Cl. ..... 337/407; 337/414

[58] Field of Search ..... 337/401–409; 429/7

[56] References Cited

U.S. PATENT DOCUMENTS 4,208,647 6/1980 McVey et al. ..... 337/404

4,255,736 3/1981 Kelley et al. ..... 337/407

4,533,897 8/1985 Olson et al. ..... 337/408

4,746,892 5/1988 Musto ..... 337/403

5,691,073 11/1997 Vu et al. ..... 429/7

*Primary Examiner*—Gerald P. Tolin

*Assistant Examiner*—Jayprakash N. Gandhi

*Attorney, Agent, or Firm*—Jones, Day, Reavis & Pogue

[57] ABSTRACT

A thermal cutoff having a single switch blade that is held in a contacts-closed position under bending stress by a thermal pellet and that moves to a contacts-open position solely by relief of the bending stress upon melting of the thermal pellet.

14 Claims, 3 Drawing Sheets

THERMAL PELLET CUTOFF SWITCH

BACKGROUND OF THE INVENTION

This application relates to the art of thermal cutoffs and, more particularly, to thermal cutoffs that interrupt an electric circuit in response to an elevated temperature. The invention is particularly applicable for use with thermal cutoffs of the type having a dielectric thermal pellet that melts at an elevated temperature to open a circuit and will be described with specific reference thereto. However, it will be appreciated that the invention has broader aspects, and that certain features of the invention can be used in other types of thermal cutoffs and for other purposes.

Supplemental springs often are used in thermal cutoffs for biasing a movable contact to a closed position, to an open position, or both. Such springs add parts that complicate assembly and require manufacturing precision for obtaining proper operation of the finished thermal cutoff. Thermal cutoffs that use two resilient switch blades require contacts on both blades. Stresses applied to the blades during assembly sometimes cause one blade to yield beyond its elastic limit at a bend, resulting in a thermal cutoff that has less than optimum operating characteristics. Two blade designs have also applied relatively high force per unit area to a thermal pellet that causes the pellet to yield over time. It would be desirable to have a simplified thermal cutoff that alleviates many of the problems of the type described as well as others that are not described.

SUMMARY OF THE INVENTION

A thermal cutoff of the type described has a single resilient switch blade that carries a movable contact. A fixed contact cooperates with the movable contact and the switch blade is movable from a contacts-closed position to a contacts-open position.

A thermal pellet engages the switch blade and holds it in the contacts-closed position under bending stress. Upon melting of the thermal pellet, relief of the bending stress provides the sole force that moves the switch blade to the contacts-open position.

In an preferred arrangement, the switch blade has a flat blade area engaging a flat pellet area to minimize the compressive force per unit area applied to the thermal pellet by the switch blade. This improves the aging characteristics of the thermal pellet by minimizing pellet shrinkage over an extended period of time.

In one arrangement, the fixed contact is a metal disc cover that forms part of a housing enclosing the switch blade and thermal pellet.

The switch blade has a mounting end portion opposite from the movable contact, and the central axis of the thermal pellet intersects the switch blade intermediate the movable contact and the blade mounting end portion. Thus, the movable contact and the switch blade mounting end portion are located on opposite sides of the central axis of the thermal pellet.

In a preferred arrangement, the switch blade is bent upwardly from its mounting end portion along a smoothly curved spring portion. The switch blade is then bent downwardly from the curved spring portion to define an elongated flat pellet engaging portion. The switch blade is then bent upwardly from the flat pellet engaging portion to define an elongated substantially straight contact spring portion that carries the movable contact. With the contacts closed, the pellet is in engagement with the flat pellet engaging portion to hold the curved spring portion under upward bending stress and the contact spring portion under downward bending stress.

In accordance with another aspect of the invention, the switch blade and pellet are positioned between upper and lower dished discs. The pellet has a height that is substantially greater than one-half of the interior distance between the upper and lower discs. The elongated flat portion of the switch blade preferably extends more than one-half of the distance across the flat end surface of the thermal pellet.

It is a principal object of the invention to provide an improved thermal cutoff assembly that has fewer parts, and is easier to manufacture and assemble.

It is another object of the invention to provide a thermal cutoff that has a single resilient switch blade and no supplemental springs.

It is an additional object of the invention to provide a thermal cutoff that improves the aging characteristics of a thermal pellet.

DESCRIPTION OF PREFERRED EMBODIMENTS

Figure 1:
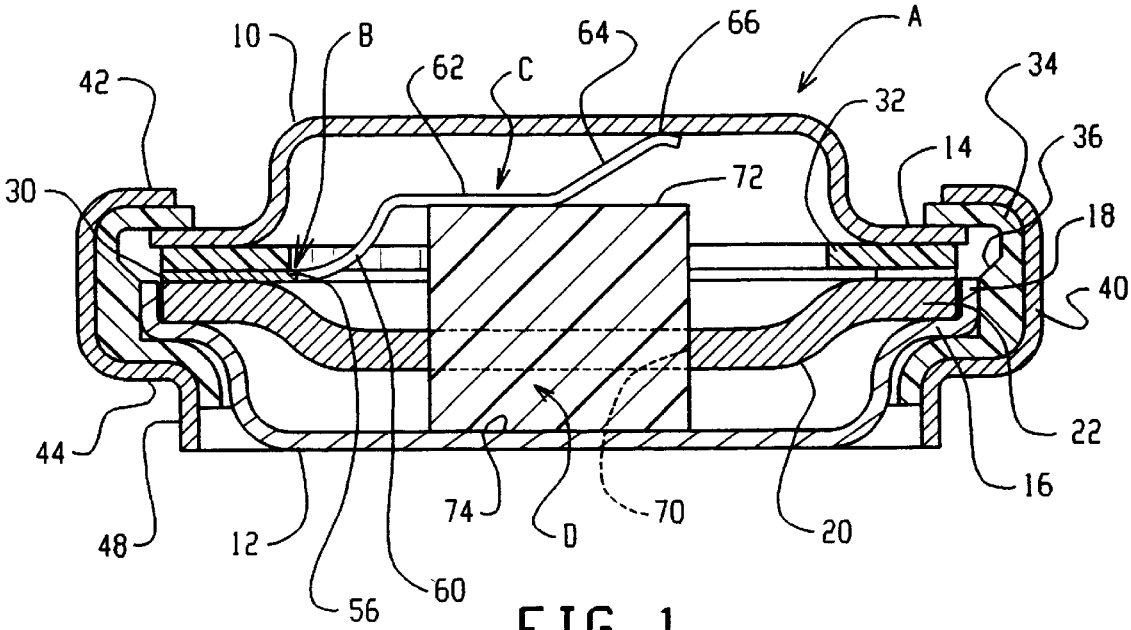
FIG. 1 is a cross-sectional elevational view of a thermal cutoff constructed in accordance with the present application and showing a resilient switch arm in a contacts-closed position.
Figure 2:
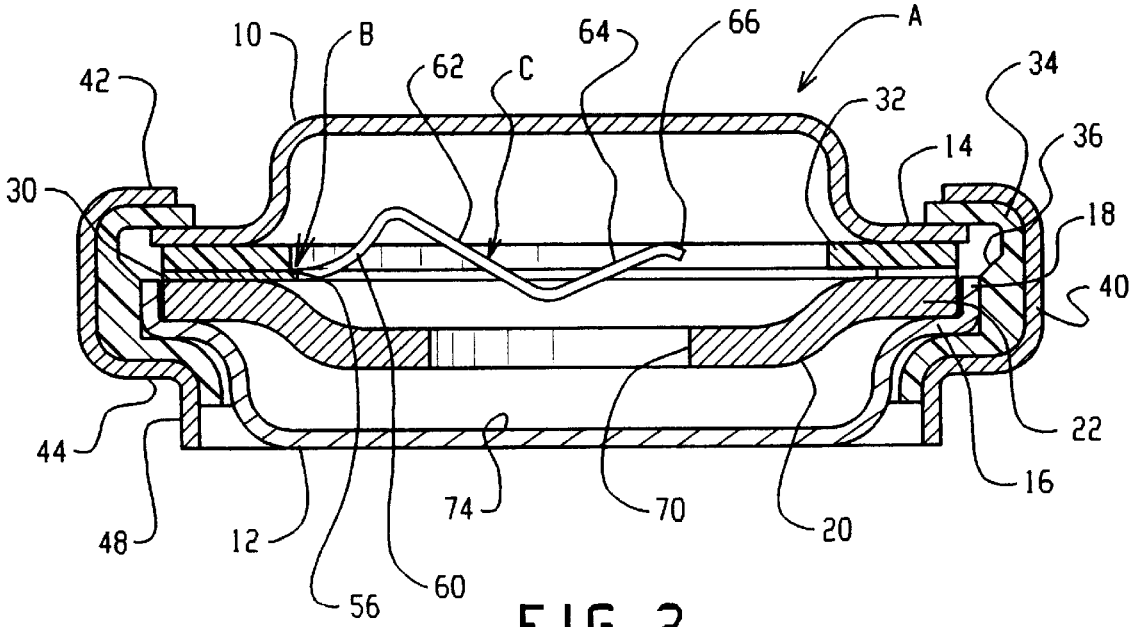
FIG. 2 is a view similar to FIG. 1 showing the resilient switch blade in a contacts-open position.

Referring now to the drawings, wherein the showings are for purposes of illustrating certain preferred embodiments of the invention only and not for purposes of limiting same, FIGS. 1 and 2 show a thermal cutoff A constructed in accordance with the present application. A housing for the thermal cutoff assembly includes metal dished discs forming a cover 10 and a bottom 12. The peripheral portions of both discs extend horizontally outward to provide circumferential peripheral flanges 14, 16. Peripheral flange 16 on bottom disc 12 terminates an upwardly extending cylindrical ring 18.

A metal dished inner disc 20 has a circular peripheral portion 22 received within cylindrical ring 18 on bottom disc 12 and rests on peripheral flange 16. Inner disc 20 is much thicker than top and bottom discs 10, 12 for rigidifying assembly A.

A one-piece switch blade unit B has a base portion 30 positioned between peripheral portions 14 and 22 on top disc 10 and inner disc 20. A dielectric annular gasket 32 is positioned on top of base portion 30 between peripheral portions 14, 22 on top disc 10 and inner disc 20.

A dielectric ring 34 has an inwardly opening recess 36 for closely receiving the peripheral portions of discs 10, 12, 20, along with peripheral portions of gasket 32 and base portion 30 on switch blade unit B. A metal clamping ring 40 is deformed inwardly as indicated at 42, 44 to tightly clamp together axially within recess 36 of ring 34 the peripheral portions of discs 10, 12, 22, gasket 32, and base portion 30 of switch blade unit B. The clamped peripheral portions are in compression under the clamping action of clamping ring 40. Clamping ring 40 terminates in a lower cylindrical ring portion 48 that has a terminal end lying in substantially the same plane as the flat outer surface of bottom disc 12.

Figure 5:
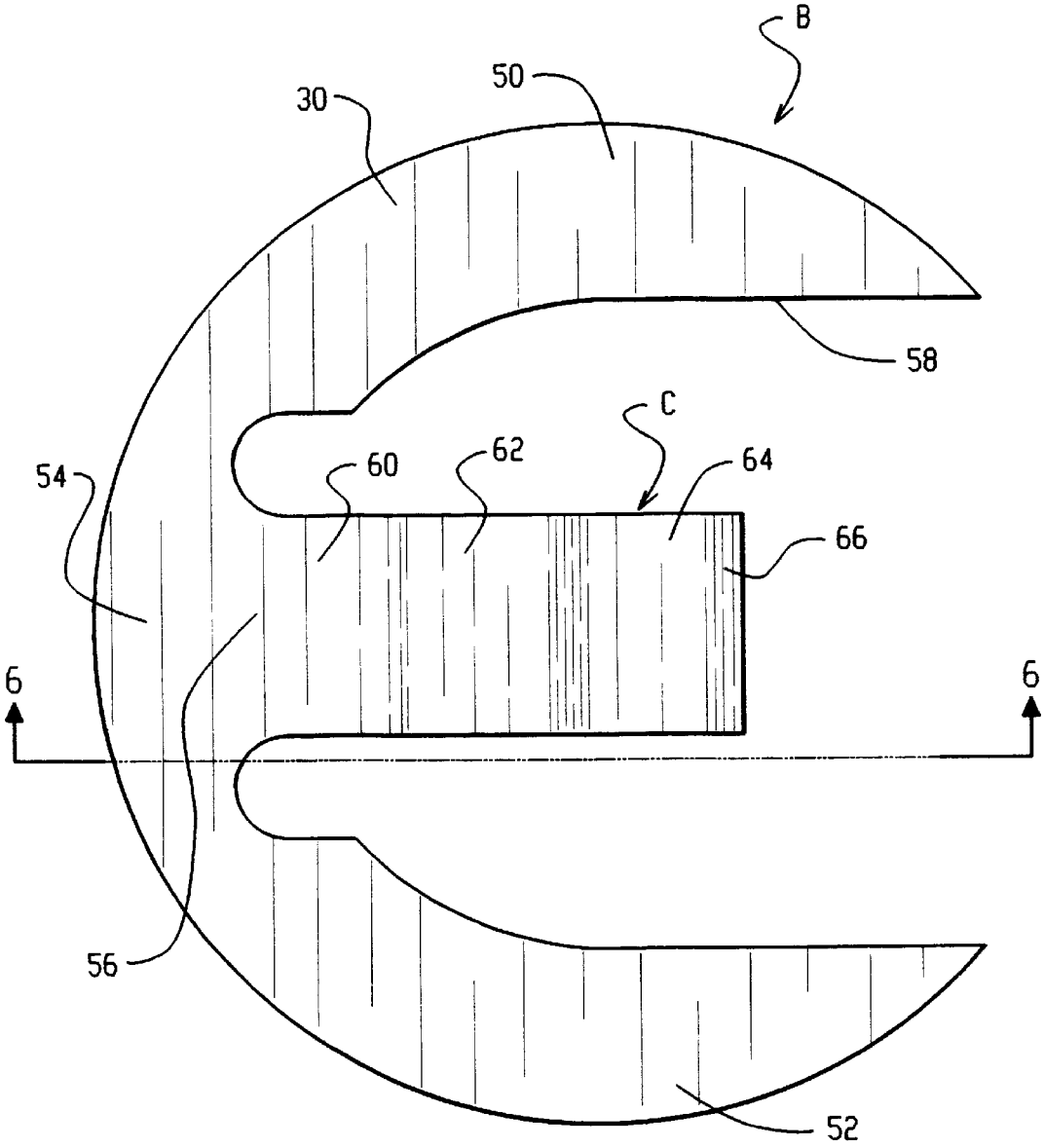
FIG. 5 is a top plan view of a switch blade unit.
Figure 6:
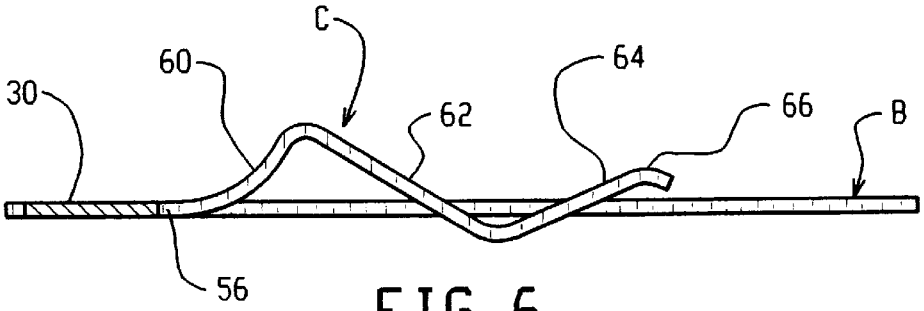
FIG. 6 is a cross-sectional elevational view taken generally on line 6—6 of FIG. 5.

FIGS. 5 and 6 show base portion 30 of switch blade unit B as having a generally annular U-shaped configuration that includes opposite curved legs 50, 52 and a curved connecting portion 54. Resilient switch blade C is connected with base portion 30 along an integral connecting portion 56 and projects into a central opening 58 in base portion 30 between legs 50, 52. Resilient switch blade C has an upwardly curved portion 60 that smoothly curves inwardly and upwardly to define an upwardly curved spring portion 60. Switch blade C is then bent downwardly from the upwardly curved spring portion to define an elongated flat portion 62 that extends downwardly through central opening 58 in base portion 30 in the relaxed position of the switch blade as shown in FIG. 6. Resilient switch blade C is then bent upwardly from flat portion 62 to define an elongated straight contact spring portion 64 that extends back upwardly through central opening 58 in base portion 30 in the relaxed position of the switch blade as shown in FIG. 6. The terminal end portion of contact spring portion 64 is downwardly curved to define a movable contact 66 located above the base plane in which flat base portion 30 lies in the relaxed position of the switch blade as shown in FIG. 6. In the relaxed and unstressed condition of resilient switch blade C shown in FIG. 6, curved spring portion 60 extends upwardly above the base plane of base portion 30 a substantially greater distance than contact 66 extends above such plane. That is, the sharp bend separating curved portion 60 and flat portion 62 is much higher above base portion 30 than contact 66.

A central circular hole 70 in inner disc 20 closely receives a cylindrical thermal pellet D having flat and parallel opposite ends 72, 74. Flat bottom surface 74 of thermal pellet D is supported on the flat inner surface of bottom disc 12. The height of thermal pellet D is such that flat portion 62 of switch blade C is substantially horizontal in FIG. 1 and in engagement along its length with flat top end 72 of the thermal pellet. Upwardly curved spring portion 60 is then under upward bending stress. Switch blade contact 66 engages the inner surface of top disc 10 which defines a fixed contact, and contact spring portion 64 is under downward bending stress. Upon melting of thermal pellet D, relief of the stress in switch blade C is the sole force that returns switch blade C to the unstressed condition shown in FIG. 2 and opens the contacts.

FIG. 1 shows the contacts-closed condition while FIG. 2 shows the contacts-open position. Flat switch blade portion 62 preferably extends at least one-half of the way across flat end 72 of thermal pellet D. Blade to base connecting portion 56 and contact 66 are located on opposite sides of the longitudinal axis of thermal pellet D in the contacts-closed position of FIG. 1.

Figure 3:
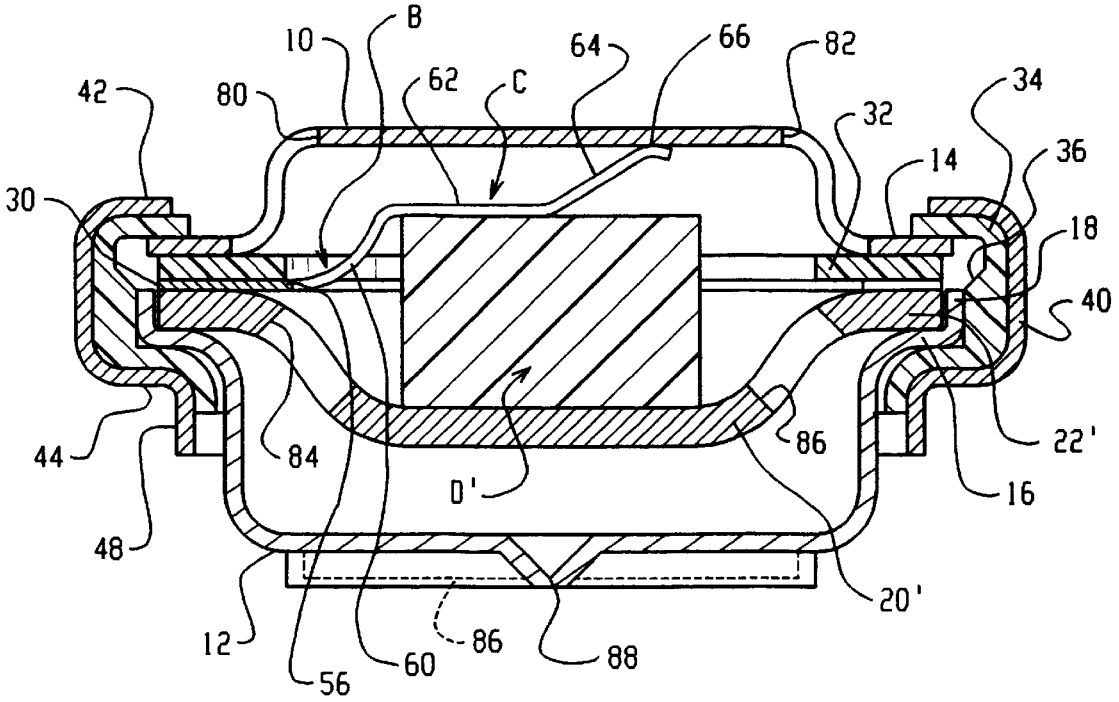
FIG. 3 is a view similar to FIG. 1 showing another embodiment.
Figure 4:
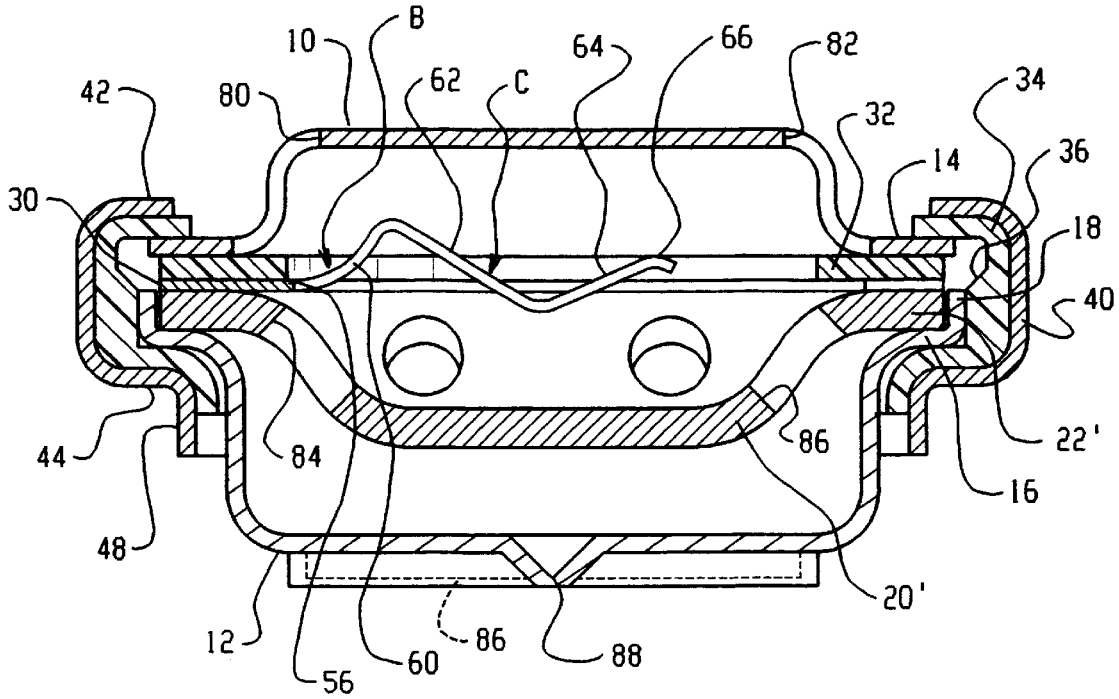
FIG. 4 is a view similar to FIG. 3 showing the resilient switch blade in a contacts-open position.

FIGS. 3 and 4 show another arrangement wherein inner dished disc 20' does not have a central hole therein and itself supports a thermal pellet D' of reduced height. Openings generally indicated at 80, 82 in top disc 10 and at 84, 86 in inner disc 20' provide vent openings for relieving pressure. Bottom disc 12 is scored as generally indicated at 86, 88 for rupturing when subjected to a predetermined pressure on the opposite side thereof from inner disc 20'. FIG. 3 shows the contacts-closed position with thermal pellet D' solid while FIG. 4 shows the contacts-open position after thermal pellet D' has melted.

The thermal pellet may be made of many different organic compounds, and typical examples include caffeine and animal protein. The chemical compound chosen will depend upon the desired melting point and other properties of the thermal pellet.

The lower disc that supports the thermal pellet is defined by the bottom disc 12 in the arrangement of FIG. 1, and is defined by the inner disc 20' in the arrangement of FIG. 3.

Some dimensions will be given in millimeters for purposes of illustration only and not by way of limitation. The overall height of assembly A between the outer surfaces of top and bottom discs 10, 12 is about 4.10 mm. Pellet D has a height of about 2.8 mm and a diameter of about 2.8 mm. The distance between the inner surfaces of top and bottom discs 10, 12 is about 3.5 mm. Flat blade portion 62 has a length of about 1.9 mm and engages flat end 72 of pellet D over a length of about 1.6 mm. Straight contact portion 64 of blade C has a length of about 2.0 mm. In the unstressed position of FIG. 2, the perpendicular distance from flat blade portion 62 to the outer curved surface of contact 66 is about 1.5 mm, while this same distance in FIG. 1 with the contact portion stressed is about 0.6 mm. The distance between pellet top end 72 and the inner surface of top disc 10 is about 0.8 mm.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only the scope of the claims.

We claim:

1. A thermal cutoff having a movable contact carried by a resilient switch blade and a fixed contact for cooperation with said movable contact, said switch blade being movable between contacts-closed and contacts-open positions, a thermal pellet engaging said switch blade and placing said switch blade in said contacts-closed position with said switch blade in bending stress, said switch blade being movable to said contacts-open position by relief of the bending stress therein upon melting of said thermal pellet, said fixed contact being on the opposite side of said movable contact from said thermal pellet and facing toward said thermal pellet, said movable contact facing away from said thermal pellet and being located on the same side of said fixed contact in both of said contacts-closed and contacts-open positions thereof.

2. The thermal cutoff of claim 1 wherein said thermal pellet has a flat pellet area engaging said switch blade and said switch blade has a flat blade area engaging said flat pellet area to minimize the unit compressive force applied to said thermal pellet by said switch blade.

3. The thermal cutoff of claim 1 wherein said switch blade has a fixed mounting end portion and is bent upwardly therefrom along a curved spring portion, said switch blade being bent downwardly from said curved spring portion to define an elongated flat pellet engaging position, said switch blade being bent upwardly from said flat pellet engaging portion to define an elongated contact spring portion that carries said movable contact, said curved spring portion being under upward bending stress with said pellet engaging said flat pellet engaging portion, and said contact spring portion being under downward bending stress with said movable contact engaging said fixed contact.

4. A thermal cutoff comprising upper and lower dished metal discs defining a chamber therebetween, a thermal pellet supported on said lower disc in said chamber, a switch blade extending between said pellet and said upper disc in said chamber, said switch blade carrying a movable electrical contact, said pellet engaging said switch blade and holding same under bending stress with said movable electrical contact engaging said upper disc, said upper disc having an inner surface that faces toward said pellet and forms a fixed electrical contact that is engaged by said movable contact, said switch blade having an inclined contact spring portion extending between said pellet and said movable contact and being under bending stress between said pellet and said inner surface of said upper disc to bias said movable contact into engagement with said fixed electrical contact.

5. The thermal cutoff of claim 4 wherein said switch blade has a curved spring portion and a contact spring portion, said pellet engaging said switch blade intermediate said curved spring portion and said contact spring portion with said curved spring portion under upward bending stress and said contact spring portion under downward bending stress.

6. The thermal cutoff of claim 5 wherein said switch blade has a flat portion intermediate said curved spring portion and said contact spring portion, and said pellet having a pellet flat area engaging said flat portion of said switch blade.

7. The thermal cutoff of claim 4 wherein said pellet has a height that is substantially greater than one-half the height of said chamber between said upper and lower discs.

8. The thermal cutoff of claim 4 wherein said switch blade extends substantially more than one-half the distance across said thermal pellet.

9. A thermal cutoff including a switch blade having a curved spring portion and a contact spring portion separated by a flat blade portion, said thermal cutoff having a fixed contact and said contact spring portion carrying a movable contact, a thermal pellet engaging said flat blade portion and holding said contacts closed with said curved spring portion under upward bending stress and said contact spring portion under downward bending stress, said switch blade being movable to a contacts-open position by relief of bending stress in said curved spring portion upon melting of said thermal pellet, said fixed contact being on the opposite side of said movable contact from said pellet, said contact spring portion of said switch blade extending between said pellet and said movable contact and being under downward bending stress between said fixed contact and said pellet so as to apply a compressive force on said pellet.

10. A switch blade unit comprising a substantially flat base portion lying in a base plane and having a central opening defining an inner periphery, a resilient switch blade integral with said base portion and projecting therefrom into said central opening, said blade having an upwardly curved spring portion extending out of said base plane adjacent said base portion, said blade being bent downwardly from said upwardly curved spring portion to define a flat portion extending downwardly through said opening, said blade being bent upwardly from said flat portion to define a contact spring portion extending upwardly through said opening, said contact spring portion having an upwardly facing contact thereon above said base plane.

11. The switch blade unit of claim 10 wherein said upwardly curved spring portion extends a greater distance above said base plane than said contact when said switch blade is in a relaxed unstressed condition.

12. A thermal cutoff having a movable contact carried by a resilient switch blade and a fixed contact for cooperation with said movable contact, said switch blade being movable between contacts-closed and contacts-open positions, a thermal pellet engaging said switch blade and placing said switch blade in said contacts-closed position with said switch blade in bending stress, said switch blade being movable to said contacts-open position by relief of the bending stress therein upon melting of said thermal pellet, and said fixed contact comprising a disc cover that forms part of a housing that encloses said switch blade and said thermal pellet.

13. A thermal cutoff having a movable contact carried by a resilient switch blade and a fixed contact for cooperation with said movable contact, said switch blade being movable between contacts-closed and contacts-open positions, a thermal pellet engaging said switch blade and placing said switch blade in said contacts-closed position with said switch blade being movable to said contacts-open position by relief of the bending stress therein upon melting of said thermal pellet, said switch blade having a fixed mounting end portion opposite said movable contact and said thermal pellet having a central axis, said fixed mounting end portion and said movable contact being on opposite sides of said central axis.

14. A thermal cutoff having a movable contact carried by a resilient switch blade and a fixed contact for cooperation with said movable contact, said switch blade being movable between contacts-closed and contacts-open positions, a thermal pellet engaging said switch blade and placing said switch blade in said contacts-closed position with said switch blade in bending stress, said switch blade being movable to said contacts-open position by relief of the bending stress therein upon melting of said thermal pellet, said switch blade and pellet being positioned between upper and lower dished discs and said pellet having a height that is substantially greater than one-half the internal distance between said upper and lower discs.

* * * * *